US011136741B2

(12) United States Patent
Harr

(10) Patent No.: US 11,136,741 B2
(45) Date of Patent: Oct. 5, 2021

(54) HYDRAULIC ROTATOR APPARATUS

(71) Applicant: Indexator Rotator Systems AB, Vindeln (SE)

(72) Inventor: Joakim Harr, Vindeln (SE)

(73) Assignee: Indexator Rotator Systems AB, Vindeln (SE)

( * ) Notice: Subject to any disclaimer, the term of this patent is extended or adjusted under 35 U.S.C. 154(b) by 0 days.

(21) Appl. No.: 16/972,412

(22) PCT Filed: Apr. 15, 2019

(86) PCT No.: PCT/EP2019/059657
§ 371 (c)(1),
(2) Date: Dec. 4, 2020

(87) PCT Pub. No.: WO2019/233665
PCT Pub. Date: Dec. 12, 2019

(65) Prior Publication Data

US 2021/0254303 A1 Aug. 19, 2021

(30) Foreign Application Priority Data

Jun. 8, 2018 (SE) ..... 1850692-3

(51) Int. Cl.
*E02F 3/36* (2006.01)
*F01C 1/344* (2006.01)
(Continued)

(52) U.S. Cl.
CPC ..... *E02F 3/3681* (2013.01); *B66C 3/005* (2013.01); *B66C 13/08* (2013.01); *F01C 1/344* (2013.01)

(58) Field of Classification Search
CPC ..... E02F 3/3681; F01C 1/344; B66C 3/005; B66C 13/08
See application file for complete search history.

(56) References Cited

U.S. PATENT DOCUMENTS

2015/0016934 A1* 1/2015 Cooper ..... A01G 23/003 414/735

FOREIGN PATENT DOCUMENTS

CA 2 820 565 A1 1/2015
DE 3146693 A1 * 6/1983 ..... B66C 3/16
(Continued)

*Primary Examiner* — Audrey B. Walter
(74) *Attorney, Agent, or Firm* — Blank Rome LLP

(57) ABSTRACT

The invention relates to a hydraulic rotator (11) for rotating a tool with respect to a crane arm, the hydraulic rotator comprising a first attachment piece (12) for connection to a crane arm and a second attachment piece (13) for connection to a tool; and a stator (14) and a rotor (15), the rotor (15) being rotatably arranged inside the stator (14) to rotate around an axial axis (A), wherein the rotor (15) comprises vanes (18) that are biased to extend radially outwards from said rotor (15), and wherein the stator (14) comprises an inner circumferential surface (25) to receive said vanes (18), which inner circumferential surface (25) comprises at least two chambers (19*a*) arranged to receive each vane of said vanes (18) to a first extent, and at least two shallow portions (19*b*) arranged to receive each vane of said vanes (18) to a second extent, which is substantially less compared to said first extent, wherein said inner circumferential surface (25) is arranged to receive at least a tip portion of the vanes (18) throughout its whole periphery.

6 Claims, 5 Drawing Sheets

(51) Int. Cl.
*B66C 3/00* (2006.01)
*B66C 13/08* (2006.01)

(56) References Cited

FOREIGN PATENT DOCUMENTS

WO WO 03/082725 A1 10/2003
WO WO 2018/038675 A1 3/2018

* cited by examiner (PRIOR ART)

HYDRAULIC ROTATOR APPARATUS

TECHNICAL FIELD

The invention relates to a hydraulic rotator for rotating a tool with respect to a crane arm. Specifically, the invention relates to the configuration of a hydraulic vane motor in such a rotator.

BACKGROUND

Hydraulic rotators are widely used in foresting, harvesting or the like where a carrier, truck, tractor or the like carries such an apparatus to provide rotatable connection for excavators, timber tools, harvest tools or the like. The hydraulically driven apparatuses are arranged to the free end of a crane arm or the like. A rotator includes a motor, typically a hydraulic vane motor, to provide the rotational movement.

Such rotator arrangements are exposed to heavy forces both radially and axially. Conventionally, these heavy forces are handled by dimensioning the rotator arrangement and specifically the motor with components adapted to withstand very high efforts. In combination to this high mechanical demands the precision of the components, including the fit between the stator and rotor needs to be very accurate and precise.

Further, to provide a motor with as small losses as possible the precision between the stator and rotor needs to be very exact, both axially and radially. This is due to the fact that each gap in the active part of the motor, i.e. the part of the motor where pressurised hydraulic fluid is present, will yield a loss in efficiency. The combination of this very high demand on the precision and the equally high demands on strength makes the production very difficult and costly.

A specific problem related to a vane motor is that the precision of the vanes with respect to the chambers of the stator needs to be very precise in order to minimize internal leakage. Further, in conventional vane motors, the vanes and/or an active part of the rotor will be exposed to axial forces acting on the rotor with respect to the active part of the stator. This may lead to that the motor will seize, unless the precision is very high or that the active parts of the rotor and stator are dimensioned to cope with axial forces to a satisfactory degree. This is more closely described in the first part of the detailed description of this specification, in which reference is made to a prior art hydraulic rotator.

Therefore, there is a need of a hydraulic rotator that has a good precision and that has a better force distribution on parts of the motor that carry high loads.

SUMMARY OF THE INVENTION

It is an object of the present invention to provide a hydraulic rotator with good precision and with a good tolerance with respect to external loads acting on the hydraulic rotator.

The invention relates to a hydraulic rotator for rotating a tool with respect to a crane arm, the hydraulic rotator comprising:

a first attachment piece for connection to a crane arm and a second attachment piece for connection to a tool;

a stator and a rotor, the rotor being rotatably arranged inside the stator to rotate around an axial axis, wherein the stator comprises an inner circumferential surface, and wherein the rotor comprises vanes that are biased to extend radially outwards from vane openings in an external surface of said rotor and abut said inner circumferential surface around its whole periphery, wherein said inner circumferential surface of the stator is limited in an axial direction by a first circumferential rim arranged to be in contact with a first axial end portion of the vanes and a second circumferential rim arranged to be in contact with a second axial end portion of the vanes, to guide said vanes and to provide a sealing with respect to said vanes along both the first and the second axial end portions of the vanes, wherein a track is formed between the first and second circumferential rims, such that a gap exist between the external surface of the rotor and the inner circumferential surface over the whole periphery of a central portion of the outer surface of the rotor, and wherein a first cylindrical portion and a second cylindrical portion of the rotor circumferentially abut the inner circumferential surface of the stator above and below said first and second circumferential rims, respectively.

This construction with a gap between the outer surface of the rotor and the inner circumferential surface of the stator involves several advantages. Firstly, obviously, the outer surface of the rotor need not be exactly adapted to the inner circumferential surface of the stator, such that production costs may be cut. Further though, this construction may involve less internal leakage than a conventional hydraulic rotator. Thereby, the motor efficiency of the hydraulic rotator may also be improved.

In a specific embodiment the external surface of the rotor is substantially cylindrical with a constant diameter over its axial length extending from the first cylindrical portion over the central portion and into the second cylindrical portion. In this context the term substantially cylindrical signifies that the external surface of the rotor is cylindrical with a circular cross section from the first cylindrical portion over the central portion and into the second cylindrical portion, but that irregularities may be provided in the central portion, and that vane openings are provided with an extension from the first cylindrical portion over the whole central portion and into the second cylindrical portion.

In a specific embodiment the stator includes a first stator plate, which is rigidly connected to the first attachment piece, a second stator plate, and a stator frame arranged between said first and second stator plates, wherein the inner circumferential surface is defined by an inner surface of the stator frame in the radial direction, and wherein the height of the vanes corresponds to a height of the stator frame, the first circumferential rim being formed by a first surface of the first stator plate, and the second circumferential rim being formed by a first surface of the second stator plate.

In a specific embodiment the external surface of the rotor is substantially cylindrical and has a height that is greater than a height between said first circumferential rim and said second circumferential rim.

Preferably the rotor extends both above said first circumferential rim and below said second circumferential rim. This construction implies that the circumferential rim support only the vanes in the axial direction, and not the rotor. The rotor may instead be supported by an axial bearing at the lower end, and by an axial contact between the rotor and the stator at the upper end of the rotor.

In a specific embodiment at least two chambers are formed between said inner circumferential surface and the intermediate cylindrical surface of said rotor, said two chambers being separated from each other on both sides by shallow portions arranged to radially receive said vanes to a second extent, which is substantially less compared to said first extent, but sufficient to allow the vanes to extend out from the outer surface of the rotor In a specific embodiment each shallow portion extends over the same or a greater angle than the angle formed between two adjacent vanes such that at least one vane is located at each shallow portion at all times.

With this arrangement is achieved that the chambers are separated from each other by the interaction between the shallow portions and the at least one vane that is located at said shallow portion. This interaction replaces the close interaction of partition walls of the stator and the outer surface of the rotor in prior art arrangements.

In a specific embodiment each shallow portion extends over 72° or more wherein the rotor comprises at least 5 equidistantly arranged vanes, and in another specific embodiment each shallow portion extends over 60° or more, wherein the rotor comprises at least 6 equidistantly arranged vanes.

Other embodiments and advantages will be apparent from the detailed description and the appended drawings.

BRIEF DESCRIPTION OF DRAWINGS

An exemplary embodiment related to the invention will now be described with reference to the appended drawings, in which.

DETAILED DESCRIPTION OF DRAWINGS

Figure 1:
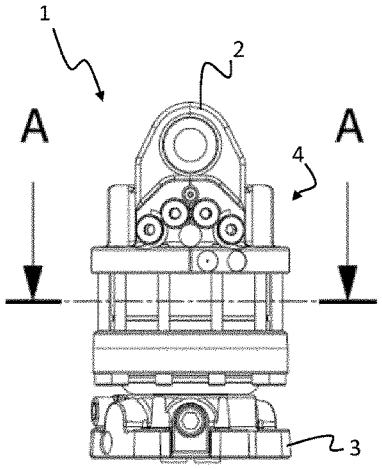
FIG. 1, 1*a*-1*c* show a prior art hydraulic rotator.
Figure 1A:
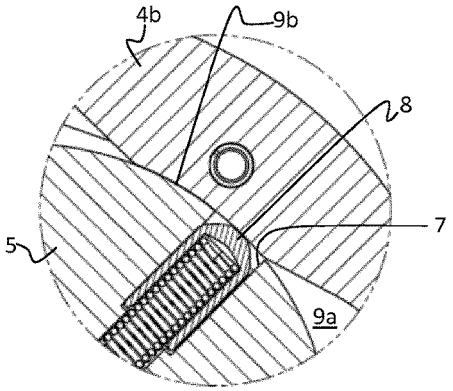
Figure 1B:
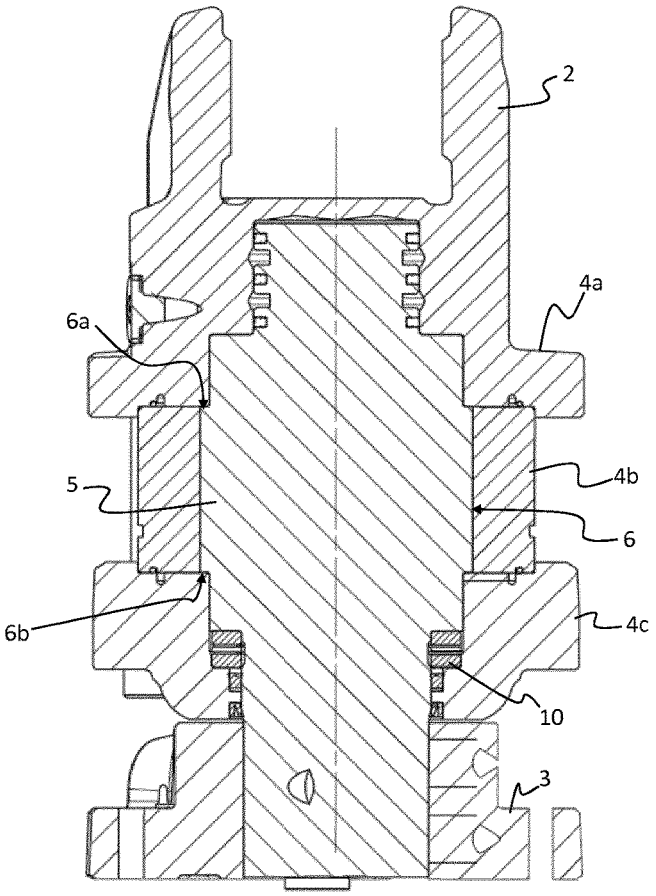
Figure 1C:
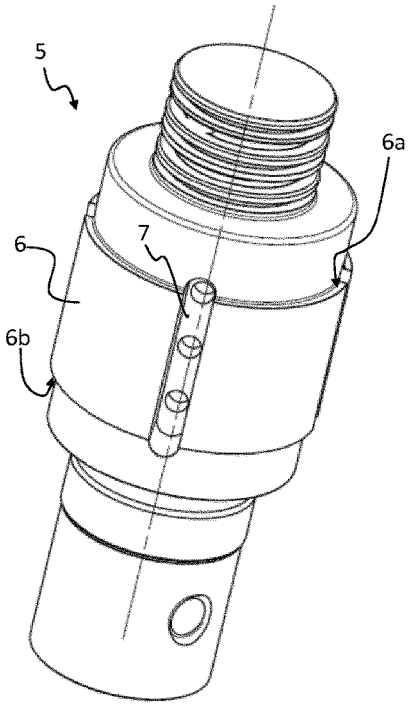

In FIGS. 1 and 1A-1C a prior art rotator is shown. This prior art rotator is not part of the invention. The shown prior art rotator 1 has a first attachment piece 2 for connection to a crane arm and a second attachment piece 3 for connection to a tool. The first attachment piece 2 is attached to a stator 4 and the second attachment piece 3 is attached to a rotor 5, the rotor being rotatably arranged inside the stator 4. As is shown in FIG. 1B the stator is comprised of three parts; a first stator plate 4*a* which is integrated with the first attachment piece 2, a second stator plate 4*c*, and a stator frame 4*b*, which is the active part of the stator and is arranged between the first and second stator plates 4*a* and 4*c*.

The rotor 5 is arranged inside the stator 4, and the second part of the rotor 5 is connected to the second attachment piece 3. As is apparent from FIG. 10, the rotor 5 comprises a cylindrical portion 6 that extends radially outside a main body of the rotor. The height of the cylindrical portion 6 corresponds to the height of the stator frame 4*b* and is arranged to be received between the first and second stator plates 4*a* and 4*c*, respectively. In order to make sure that hydraulic fluid will not leak along the edges of the cylindrical portion 6 of the rotor and the first and second stator plates 4*a* and 4*c*, respectively, the cylindrical portion 6 shall fit as tightly as possible between the first and second stator plates 4*a* and 4*c*. The cylindrical portion 6 is delimited by a first circumferential rim 6*a* and second circumferential rim 6*b* arranged to face inner circumferential edge portion of the first and second stator plates 4*a* and 4*c*, respectively.

The cylindrical portion 6 of the rotor comprises four vane openings 7 that extend along the axial axis of the rotor 5. In each vane opening 7, a spring biased vane 8 is arranged. The hydraulic motor is driven in either direction by providing a pressurised hydraulic fluid at a first side of the vanes and a non-pressurised hydraulic fluid at the opposite second side of the vanes. The height of the vanes 8 correspond precisely to the height of the cylindrical portion 6 of the rotor 5 such that the edge portions of the vanes 18 are arranged in line with the first and second circumferential rim 6*a* and 6*b*, respectively. Hence, the height of the vanes 8 also correspond to the height of the stator frame 4*b*, such that the vanes 8 fit tightly between the first and second stator plates 4*a* and 4*c* and are guided by said stator plates.

In FIG. 1A a detailed sectional view of the rotor 5 and the stator frame 4*b* is shown. The rotation of the rotor 5 is achieved in that pressurised hydraulic fluid is provided to a first end of a chamber 9*a*, arranged in the stator frame 4*b*. Normally, the stator frame 4*b* comprises two chambers. Which are separated from each other by partition walls 9*b*. The precision between the partition walls 9*b* and the cylindrical portion 6 of the rotor 5 needs to be very high in order to make sure that the hydraulic fluid will not leak from one chamber to another.

A main object of the cylindrical portion 6 of the rotor 5 is to make sure that the vanes 8 will be guided into the chambers 9*a* after passing a partition wall 9*b*. This is achieved in that the vanes 8 are guided by the support of the first and second stator plates 4*a* and 4*c*, as well when they are located in the chambers 9*a* as when they face one of the partition walls 9*b*. Hence, both the vanes 8 and the cylindrical portion 6 of the rotor 5 are received and guided between the first and second stator plates 4*a* and 4*c* around the whole lap of the rotor 5.

As is shown in FIG. 1B, an axial bearing 10 is arranged to handle the loads acting downwards on the rotor 5 with respect to the stator 4, The bearing 10 is supported by the second stator plate 4*c*.

A complication with this construction is that the interaction needs to be adapted to the high precision contact between the cylindrical portion 6 of the rotor 5 and the first and second stator plates 4*a* and 4*c*. Specifically, the downward load acting on the rotor 5 shall be handled by the axial bearing 10 and not by the interaction between the second edge of the cylindrical portion 6 of the rotor 5 and first part of the second stator plate 4*c*. This calls for a precision that is very difficult to achieve and therefore shims of an exact thickness need to be provided between the rotor 5 and the second stator plate 4*c*. Further, the construction is prone to internal leakage of hydraulic fluid if the precision is not perfect.

In the inventive rotator, the precision is achieved by an alternative construction that separates the axial load bearing from the active interaction of the stator with both the rotor and the vanes of the rotor.

Figure 2:
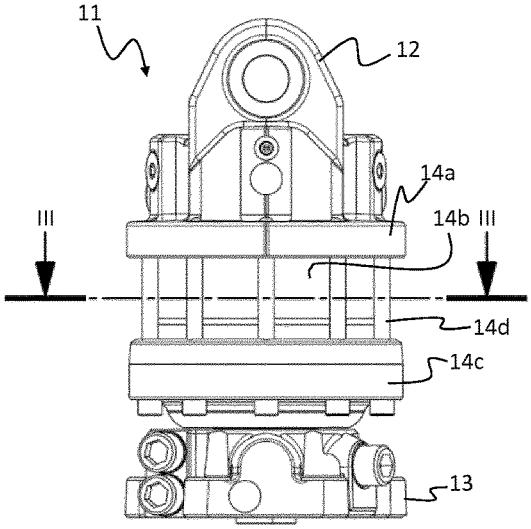
FIG. 2 is a side view of a hydraulic rotator according to a specific embodiment of the invention.

FIG. 2 shows a specific embodiment of a hydraulic rotator 11 for rotating a tool (not shown) with respect to a crane arm or the like (not shown). The shown hydraulic rotator comprises a first attachment piece 12 and a second attachment piece 13. In the shown embodiment the first attachment piece 12 is arranged for connection to said crane arm and the second attachment piece 13 is arranged for connection to said tool. The rotator 11 comprises a stator 14, comprised of a first stator plate 14*a* that in the shown embodiment is integrated with the first attachment piece 12, a second stator plate 14*c*, and a stator frame 14*b*, which is the active part of the stator 14 and is arranged between the first and second stator plates 14*a* and 14*c*, respectively. Attachment bolts 14*d* are arranged to hold the first and second stator plates 14*a* and 14*c* together, thereby securing the stator frame 14*b* between them. Such attachment bolts may be arranged through the stator frame 14*b* or, as in the shown embodiment, outside the stator frame 14*b*.

Figure 3A:
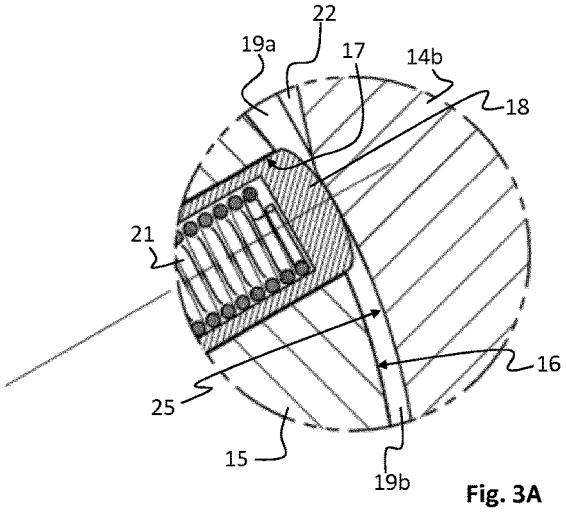
FIG. 3*a* is a detailed view of detail A in FIG. 3.
Figure 3:
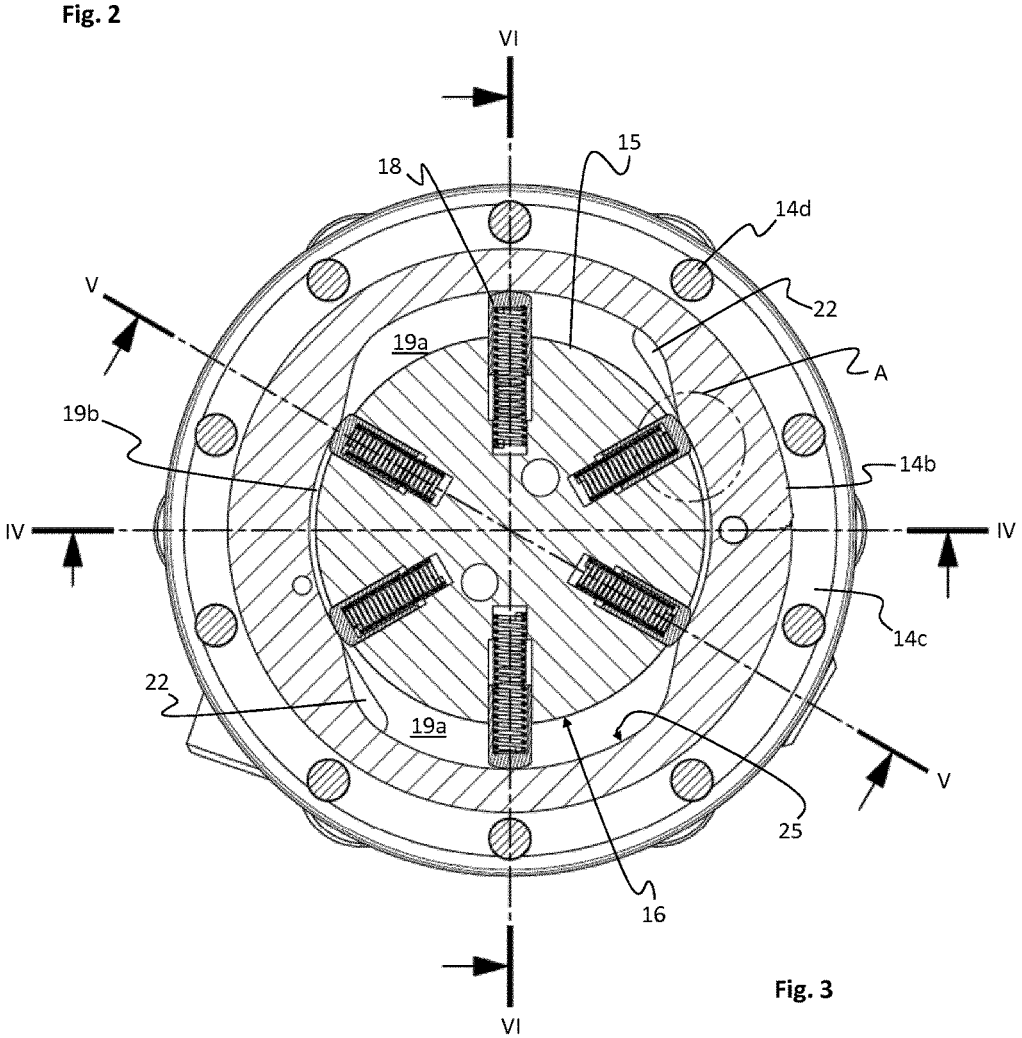
FIG. 3 is a sectional view taken along the line III-III in FIG. 2.

FIG. 3 is a sectional view taken along the line III-III in FIG. 2. From FIG. 3 it is apparent that a rotor 15 is rotatably arranged inside the stator 14 to rotate around an axial axis A (see FIGS. 4-6). The rotor 15 comprises vanes 18 that are biased to extend radially outwards from said rotor. The vanes 18 are arranged in vane openings 17 in an external surface 16 of the rotor 15. The external surface 16 of the rotor 15 is preferably substantially cylindrical. Except for the vane opening 18 the external surface 16 may be perfectly cylindrical. However, in view of that a central portion 16*b* of the rotor 15, i.e. the portion from which the vanes 18 extend, will not be in contact with the surrounding inner circumferential surface 25 of the stator, said central portion 16*b* of the rotor 15 need not be perfectly cylindrical. It may e.g. include recesses or protrusions of varying shapes, as long as such protrusion do not extend farther out from the rotor than is allowed by the gap between the rotor 15 and stator 14.

The vanes are arranged to fit inside said vane openings 17 in a manner that allows no hydraulic fluid to leak past the vanes 18. A fluid tight seal between a vane 18 and a vane opening 17 is achieved in that the hydraulic pressure acting on a vane 18 will press said vane into close contact with the opposite side of the vane opening 17, thereby preventing any leakage along the length of said vane 18 along said close contact.

Springs 21 are arranged to push the vanes 18 outwards from the vane openings 17 in the external surface 16 of the rotor 15. As is apparent from FIG. 3 the stator frame 14*b* comprises an inner circumferential surface 25 to receive the vanes 18. The inner circumferential surface 25 comprises at least two chambers 19*a* arranged to receive each vane 18 to a first extent, and at least two shallow portions 19*b* arranged to receive each vane of said vanes to a second extent, which is substantially less compared to said first extent. In the shown embodiment, the inner circumferential surface 25 comprises two chambers 19*a* and two shallow portions 19*b*, such that one chamber 19*a* is arranged between two shallow portions 19*b*, and vice versa.

The inner circumferential surface 25 of the stator is arranged to receive at least a tip portion of the vanes 18 throughout its whole periphery. In contrast to prior art configurations the central portion 16*b* of the external surface 16 of the rotor 15 does not meet the inner circumferential surface 25 of the stator. In other words, no partition wall where the external surface 16 of the rotor 15 meets the inner surface of the stator 14 is arranged. Instead, at least a tip portion of the vanes 18 will extend outside of the external surface 16 of the rotor 15 at all times.

Figure 4:
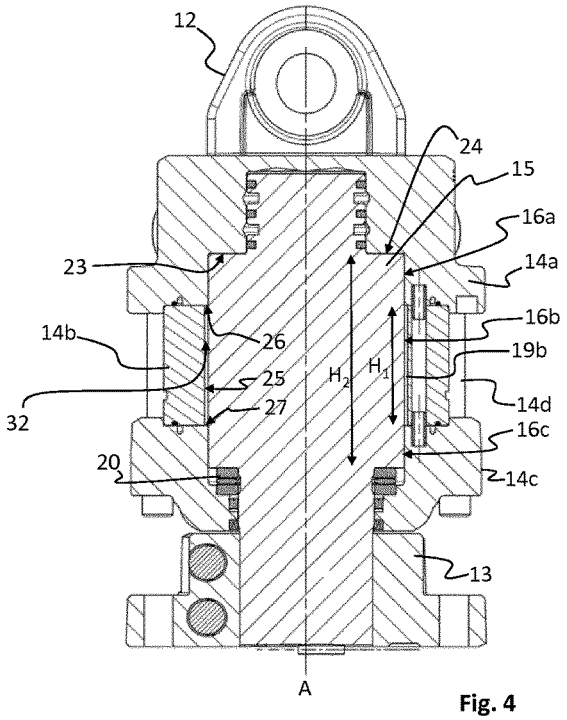
FIG. 4 is a sectional view taken along the line IV-IV in FIG. 3.

As illustrated in FIG. 4, the inner circumferential surface 25 of the stator 14 comprises a track 32 that is defined by at least one circumferential rim arranged to be in contact with an axial end portion of the vanes 18 to guide said vanes and to provide a sealing with respect to said vanes. Specifically, the axial extent of the track 32 of the inner circumferential surface 25 of the stator 14 is defined by a first circumferential rim 26 and a second circumferential rim 27, wherein the track 32 is arranged to receive said vanes 18.

In FIG. 3 a first pair of hydraulic ports 22 are shown. This first pair of hydraulic ports 22 is arranged in the second stator plate 14*c*, which is visible below the stator frame 14*b* in FIG. 3. A second pair of hydraulic ports are arranged in the first stator plate 14*a* (not shown). The hydraulic ports of the second pair are arranged diagonally across the chamber 19*a* with respect to the first pair of hydraulic ports 22. In operation one pair of hydraulic ports at a time is connected to the pressure line and the other pair is connected to tank. When the first pair of hydraulic ports 22 is connected to the pressure line, the rotor 5 will rotate counter clockwise with respect to the view shown in FIG. 3, and when the second pair of hydraulic ports is connected to the pressure line, the rotor 5 will rotate clockwise with respect to the view shown in FIG. 3.

As is apparent in FIG. 3, each shallow portion 19*b* extends over a greater angle than the angle formed between two adjacent vanes 18 such that at least one vane 18 is located at each shallow portion 19*b* at all times. Further, at least one vane must be located between the hydraulic ports of one chamber at all times. In the shown embodiment this is achieved in that the rotor 15 comprises 6 equidistantly arranged vanes 18. Further, each shallow portion 19*b* has an angular extension of more than a sixth of a lap, i.e. at least 60°. In another embodiment the shallow portions extend more than a fifth of a lap, i.e. at least 72°, wherein only 5 vanes equidistantly arranged vanes will be needed. Other embodiments are also possible. For instance, the stator may include three chambers and the rotor may include 9 vanes in order to guarantee one vane 18 will be located at each shallow portion 19*b* at all times and that at least one vane must be located between the hydraulic ports of one chamber at all times.

FIG. 3*a* is a detailed view of detail A in FIG. 3. In this view a vane 18 is shown in a position at a first end of the shallow portion 19*b*. If it will rotate counter clockwise it will enter the chamber 19*a* and pass the hydraulic port 22. The spring 21 will act to push the vane 18 outwards to abut the inner circumferential surface 25 of the stator and provide a fluid tight sealing with respect to said surface. As soon as the vane 18 will have passed the hydraulic port 22 it will be pressurized on its trailing side such that the hydraulic fluid will provide a torque forcing the vane 18 and the rotor 15 to rotate further counter clockwise. This will continue as long as the valves (not shown) are connected to provide pressurized hydraulic fluid to the first pair of hydraulic ports 22. Also apparent in FIG. 3*a* is that the outer edge of the vanes 18 have a rounded shape. Preferably though, to avoid leakage at the first and second portions of the vanes 18 the whole of this rounded portion is located outside the corresponding vane opening 17. Hence, flat sides of each vane 18 are configured to provide a sealing with respect to the corresponding sides of the vane opening 17, both when the vane 18 is located in the shallow portion 19*b* and when it is located in the chamber 19*a*. In the chambers 19*a*, a pressurized vane 18 will be rotated by the pressurized hydraulic fluid such that the leading side of the vane will provide a fluid tight sealing with respect to the corresponding adjacent edge of the vane opening 17. In the shallow portions 19*b*, on the other hand, the foremost vane will be rotated against the pressurized hydraulic fluid. Hence, for this vane, the trailing side of the vane 18 will provide a fluid tight sealing with respect to the adjacent edge of the vane opening 17.

Figure 5:
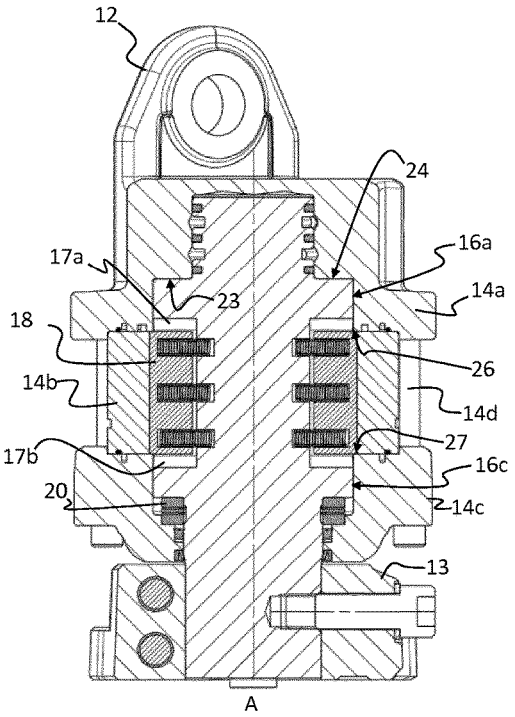
FIG. 5 is a sectional view taken along the line V-V in FIG. 3.
Figure 6:
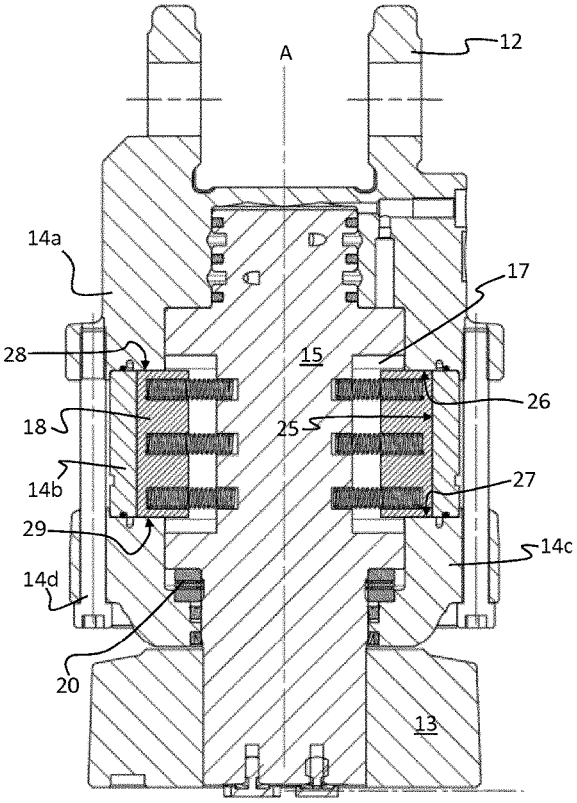
FIG. 6 is a sectional view taken along the line VI-VI in FIG. 3.

FIGS. 4-6 are longitudinal sections of the hydraulic rotator corresponding to the lines IV-IV, V-V and VI-VI, respectively, in FIG. 3. Hence, FIG. 4 is a longitudinal section of the hydraulic rotator along the line IV-IV, showing a gap between the external surface 16 of the rotor 15 and the surface of the inner circumferential surface 25 of the stator frame 14*b*. This gap forms the shallow portion 19*b*. In FIG. 4 it is shown that the external surface 16 of the rotor 15 is cylindrical over the whole of the stator frame 14*b*, and more. In the shown embodiment the external surface 16 of the rotor 15 extends both above and below the inner circumferential surface 25 of the stator 14, i.e. into both the first stator plate 14*a* and the second stator plate 14*c* of the shown embodiment. A first cylindrical portion 16*a* of the external surface 16 of the rotor 15 abuts the first stator plate 14*a* around its whole circumference, and a second cylindrical portion 16*c* abuts the second stator plate 14*c* around its whole circumference. The central portion 16*b* of the rotor 15, does not abut the opposed inner circumferential surface 25 of the stator 14. Instead, a gap exists, over the whole extent of the track 32 formed between the first circumferential rim 26 and the second circumferential rim 27.

As illustrated in the drawings the external surface 16 of the rotor 15 is substantially cylindrical with a constant diameter over its axial length, from the first cylindrical portion 16*a* over the central portion 16*b* and into the second cylindrical portion 16*c*. I.e. the external surface 16 of the rotor 15 is cylindrical with a circular cross section over its axial length, from the first cylindrical portion 16*a* over the central portion 16*b* and into the second cylindrical portion 16*c*, but that irregularities may be provided in the central portion 16*b*, and that vane openings 17 are provided with an extension from the first cylindrical portion 16*a* over the whole central portion 16*b* and into the second cylindrical portion 16*c*. The first cylindrical portion 16*a* and the second cylindrical portion 16*c* should, except for the vane openings, preferably be circularly cylindrical so as to provide a fluid tight seal between the external surface 16 of the rotor 15 and the first and the second circumferential rims 26 and 27, respectively.

An axial bearing 20 is arranged between supporting surfaces of the rotor 5 and the second stator plate 14*c*. The axial bearing 20 will support forces acting downwards on the rotor 5. The first stator plate 14*a* comprises an abutment 23 arranged to interact with a shoulder 24 on the first portion of the rotor 5. The interaction between said abutment 23 and said shoulder 24 will handle forces acting upwards on the rotor 5, e.g. when the tool is pushed down into the ground.

An advantage of the shown embodiment is that the axial forces will not be handled in the interaction between the active parts of the motor, i.e. the rotor 15 and the stator frame 14*b*. The vanes 18 are preferably arranged in a slidable manner inside the vane openings 17, such that they may be translated in the axial direction. The flexibility with regard to the axial position of the vanes 18 will assure a perfect positioning of the vanes 18 with respect to the stator. The inner circumferential surface 25 of the stator forms a track 32 in which the vanes are received, which track 32 is delimited by the two circumferential rims 26 and 27, which rims will guide the vanes 18. The flexibility with regard to the axial position of the vanes 18 is also helpful during mounting of the motor, as no shims will be needed to correctly position the rotor in the axial direction with respect to the stator.

In FIGS. 4-6 it is shown how the inner circumferential surface 25 of the stator comprises a first circumferential rim 26 arranged to be in contact with a first axial end portion 28 of each vane 18, and a second circumferential rim 27 arranged to be in contact with a second axial end portion 29 of each vane 18. The height of the vanes 18 is adapted to fit tightly between the first circumferential rim 26 and the second circumferential rim 27. The contact between the circumferential rims 26,27 and the vanes 18 is configured both to guide said vanes and to provide a sealing with respect to said vanes along both the first and the second axial end portions 28 and 29 of the vanes.

It should be noted that the external surface 16 of the rotor 15 extends both into the first stator plate 14*a* and into the second stator plate 14*c*, whereby the external surface 16 of the rotor 15 will provide a fluid tight seal with respect to both the first stator plate 14*a* and second stator plate 14*c*. For this reason, a first and second part of the external surface 16 of the rotor 15, e.g. the first and second cylindrical portions 16*a* and 16*c*, should be cylindrical and fit tightly inside the inner circumferential surfaces of the first stator plate 14*a* and second stator plate 14*c*, respectively. In a specific embodiment at least one of the first stator plate 14*a* and second stator plate 14*c* is integrated with the stator frame 14*b*, such that the limit between the stator frame 14*b* and said stator plate 14*a* and/or 14*c* will coincide with the circumferential rim 26 and/or 27.

As shown in FIG. 4 the height H2 of the external surface 16 of the rotor 15 is greater than the height $H_1$ of the inner circumferential surface 25 of the stator 14 as defined by the first and second circumferential rims 26 and 27 of the stator 14. The portions of the external surface 16 of the rotor 15 that extend beyond the height $H_1$ of the of the inner circumferential surface 25 of the stator 14 is formed by the first and second cylindrical portions 16*a* and 16*c*, respectively, of said rotor 15.

In FIG. 5, which is a longitudinal section of the hydraulic rotator along the line V-V in FIG. 3, the vanes 18 are shown in a position where they extend into the shallow portion 19*b* of the track 32 to abut the inner circumferential surface 25 of the stator. In this position, only the tips of the vanes 18 extend out from the external surface 16 of the rotor 15 and into contact with the inner circumferential surface 25 of the stator 14. The contact between the tips of the vanes 18 and the circumferential rims 26 and 27 is sufficient to provide guiding of the vanes 18, such that they will not move in the axial direction. Further, said contact will provide a sealing between the vanes and the stator 14. From FIG. 5 it is apparent that the vane openings 17 have a greater height than the vanes 18. Gaps 17*a*, 17*b* are hence available in the vane opening 17 above and below the vane 18, respectively. The gaps 17*a* and 17*b* allow the vane to move along the axial direction with respect to the vane opening 17 of the rotor 5. As discussed above, limited gaps allowing the vanes to tilt slightly exist between the sides of the vanes 18 and the corresponding vane openings 17. These limited gaps are so small that they are not clearly visible in the drawings.

FIG. 6 is a longitudinal section of the hydraulic rotator along the line VI-VI in FIG. 3. In this position the vanes 18 are located in the middle of the chamber 19*a* formed in the space between the external surface 16 of the rotor 15 and the inner circumferential surface 25 of the stator 14. As is apparent from FIG. 3, the chambers 19*a* are formed in that the stator frame 14*b* comprises two widened portions arranged opposite to each other.

The fact that no partition walls are present in the rotor apparatus 11, and that instead the vanes 18 are arranged to provide the sealing between the chambers, will imply that a foremost vane in the shallow portion will act in a direction opposite to the current rotational direction of the rotor. This is illustrated in FIG. 7, which is a close-up representing a quarter of the rotator shown in FIG. 3.

Figure 7:
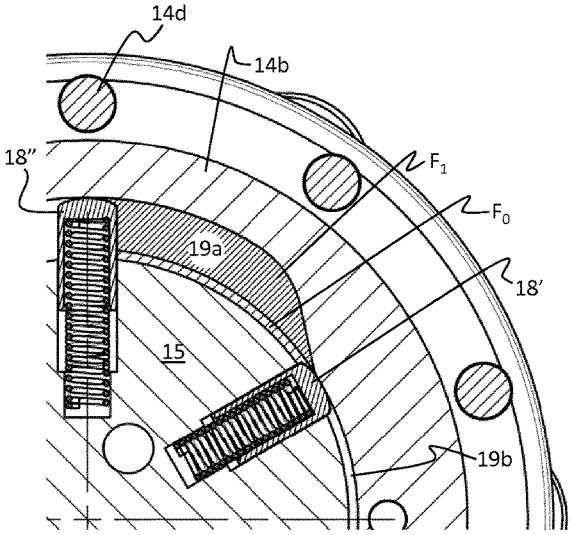
FIG. 7 is a detailed view of quarter of the sectional view in FIG. 3.

In FIG. 7 the rotor is rotated counter clockwise. A foremost vane 18' in the shallow portion will rotate opposite the pressure provided in the chamber 19*a*. The force $F_0$ resulting from the pressure acting on this foremost vane 18' will be neutralised by the force $F_0$ acting in the opposite direction on the innermost portion of the active vane 18" extending into the chamber 19*a*. The resulting torque that acts to push said active vane 18" in the counter clockwise direction is hence based on the integral of the force $F_1$ over the active surface of the active vane 18". At least one of the vanes will always be active, i.e. subjected to a high pressure on one side, at a time. In the shown embodiment two vanes, i.e. one vane per chamber will be active, at all times. This is achieved in that the chamber is wider, i.e. spans over a wider angle, than the distance between two adjacent vanes. In this way the foremost vane 18' will enter the chamber 19*a* and be put under pressure by the hydraulic fluid before the active vane 18" will have been relieved from pressure. Hence, when the foremost vane 18' has advanced counter clockwise such that it is put under pressure it will become the active vane.

The width of the shallow portion 19*b* will hence not contribute to the torque of the hydraulic motor. In this respect it should be kept as shallow as possible. The width of the shallow portion 19*b* is defined by the length of the first circumferential rim 26 and the second circumferential rim 27, and in order for said first and second circumferential rims 26 and 27 to provide a reliable guiding of the vanes, they should preferably be at least some millimetres wide, but since it implies a trade-off on the torque, it may be kept smaller. The width is therefore decided in dependence of the intended application of the rotator.

Figure 8:
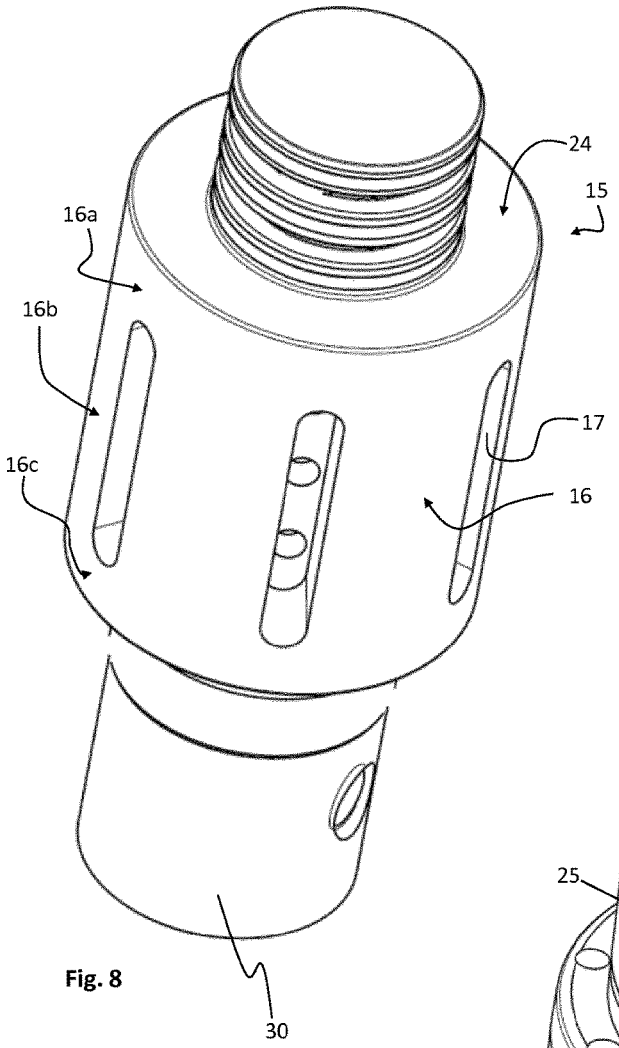
FIG. 8 is a perspective view of a rotor according to a specific embodiment of the invention.

In FIG. 8, a rotor 15 in accordance with a specific embodiment of the invention is shown. The rotor 15 comprises an external surface 16 in which vane openings 17 that extend in the axial direction of the rotor are arranged. On either end of the external surface 16 a shoulder 24 is arranged to provide a support surface to act against a corresponding surface inside the stator 14, typically the axial bearing 20 arranged at the second stator plate 14*c* and an abutment arranged in the first stator plate 14*a*. In the shown embodiment, the rotor is connected to a swivel 30, arranged to provide a swiveled hydraulic fluid to the tool arranged at the second attachment piece.

Figure 9:
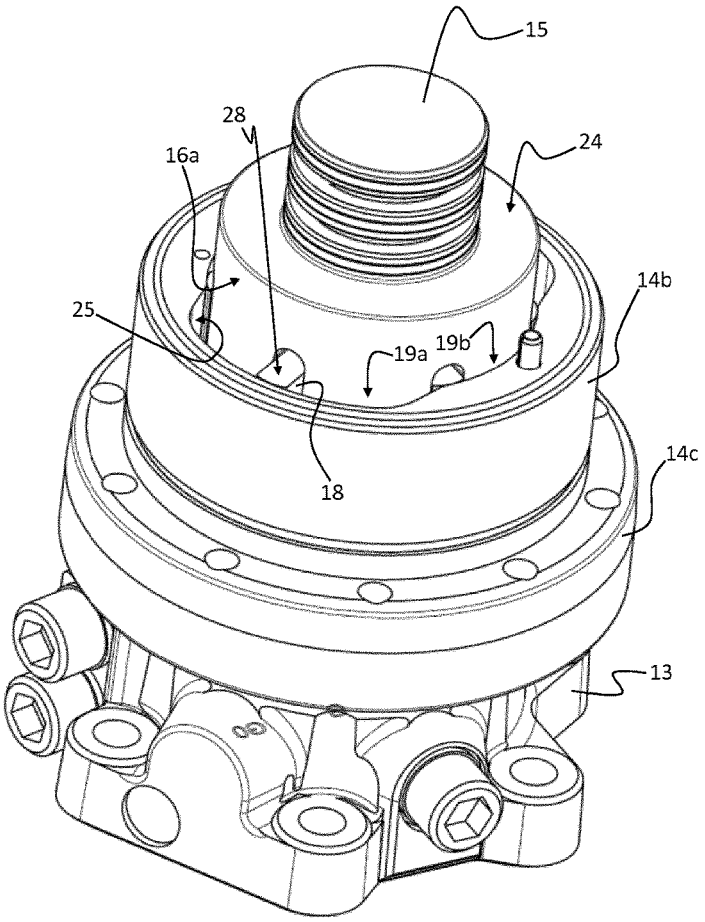
FIG. 9 is a perspective view of a hydraulic rotator according to a specific embodiment of the invention with the first stator frame and first attachment piece removed.

In FIG. 9, the rotor is shown at location inside the stator frame 14*b*. The first stator plate arranged to be provided above the stator frame 14*b* is removed for illustration purposes in FIG. 9. As is apparent in FIG. 9, the height of the vanes 18 correspond to the height of the stator frame, such that when the first stator plate 14*a* is arranged it will fit tightly above the vanes and provide a fluid tight sealing with respect to the first axial end portion 28 of the vanes 18. Similarly, the second stator plate 14*c* will provide a fluid tight sealing with respect to the second axial end portion 29 of the vanes 18.

In FIG. 9, it is illustrated how the first cylindrical portion 16*a* of the rotor 15 extends above the stator frame 14*b* to abut the inner surface of the first stator plate 14*a* around its whole circumference. Similarly, the second cylindrical portion 16*c* of the rotor 15 abuts the inner circumferential surface 25 of the second stator plate 14*c*. The interaction between the respective first and second cylindrical surfaces 16*a* and 16*c*, respectively with the first and second stator plate 14*a* and 14*c*, respectively, constitute radial bearings adapted to take up radial forces acting on the rotor 15 with respect to the stator 14.

Figure 10:
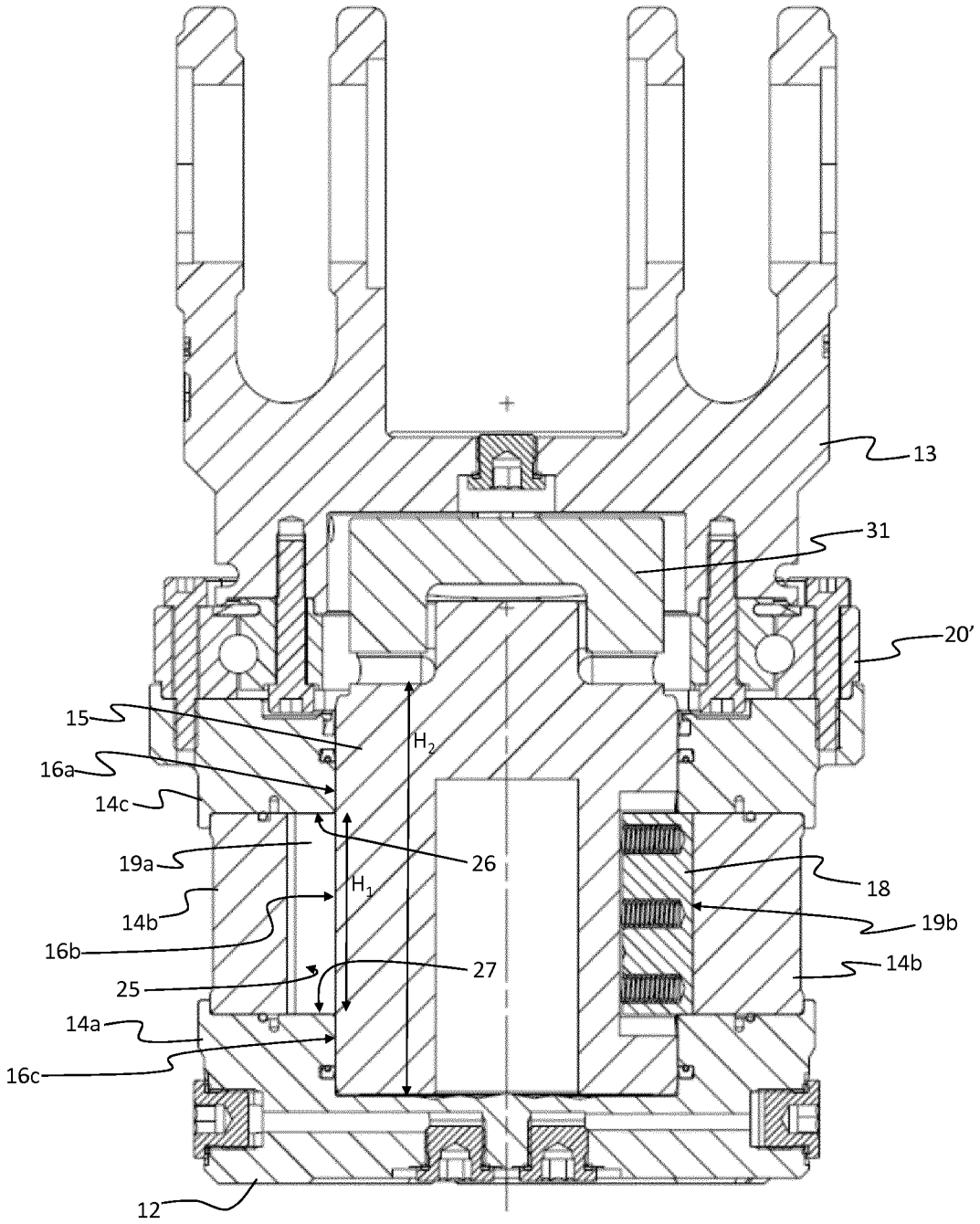
FIG. 10 is a sectional view of an alternative embodiment of the inventive hydraulic rotator.

In FIG. 10, an alternative embodiment of the inventive hydraulic rotator is shown. This alternative embodiment is similar to the embodiment shown in FIGS. 2-9 with respect to all details that are crucial for the invention. Specifically, the height H2 of the external surface 16 of the rotor 15 is greater than the height $H_1$ of the inner circumferential surface 25 of the stator 14 as defined by the first and second circumferential rims 26 and 27 of the stator 14.

A major difference of this alternative embodiment is however that the first attachment piece 12 is arranged for connection to a tool and a second attachment piece 13 is arranged for connection to a crane arm. Further, a transmission unit 31 is arranged to transmit the rotational movement between the second attachment piece 13 and the rotor 15. An external axial bearing 20' is arranged to allow the first and second attachment pieces 12 and 13 and to handle the forces acting on the rotator.

Above, the invention has been described with reference to specific embodiments. The invention is however not limited to this embodiment. It is obvious to a person skilled in the art that other embodiments are possible within the scope of the following claims.

The invention claimed is:

1. A hydraulic rotator for rotating a tool with respect to a crane arm, the hydraulic rotator comprising:

a first attachment piece for connection to a crane arm and a second attachment piece for connection to a tool;

a stator and a rotor, the rotor being rotatably arranged inside the stator to rotate around an axial axis, wherein the stator comprises an inner circumferential surface, and wherein the rotor comprises vanes that are biased to extend radially outwards from vane openings in an external surface of said rotor and abut said inner circumferential surface around its whole periphery, wherein said inner circumferential surface of the stator is limited in an axial direction by a first circumferential rim arranged to be in contact with a first axial end portion of the vanes and a second circumferential rim arranged to be in contact with a second axial end portion of the vanes, to guide said vanes and to provide a sealing with respect to said vanes along both the first and the second axial end portions of the vanes, wherein a track is formed between the first and second circumferential rims, such that a gap exist between the external surface of the rotor and the inner circumferential surface over the whole periphery of a central portion of the external surface of the rotor, and wherein a first cylindrical portion and a second cylindrical portion of the rotor circumferentially abut the inner circumferential surface of the stator above and below said first and second circumferential rims, respectively.

2. The hydraulic rotator according to claim 1, wherein the external surface of the rotor is substantially cylindrical with a constant diameter over its axial length extending from the first cylindrical portion over the central portion and into the second cylindrical portion.

3. The hydraulic rotator according to claim 1, wherein the stator includes a first stator plate, which is rigidly connected to the first attachment piece, a second stator plate, and a stator frame arranged between said first and second stator plates, wherein the inner circumferential surface is defined by an inner surface of the stator frame in a radial direction, and wherein a height of the vanes corresponds to a height of the stator frame, the first circumferential rim being formed by a first surface of the first stator plate, and the second circumferential rim being formed by a first surface of the second stator plate.

4. The hydraulic rotator according to claim 1, wherein the external surface of the rotor has a height that is greater than a height between said first circumferential rim and said second circumferential rim.

5. The hydraulic rotator according to claim 1, wherein at least two chambers are formed between said inner circumferential surface and the external surface of said rotor, said two chambers being separated from each other on both sides by shallow portions arranged to radially receive said vanes to a second extent, which is substantially less compared to said first extent, but sufficient to allow the vanes to extend out from the external surface of the rotor.

6. The hydraulic rotator according to claim 5, wherein each shallow portion extends over the same or a greater angle than the angle formed between two adjacent vanes such that at least one vane is located at each shallow portion at all times.

* * * * *